US005100094A

United States Patent [19]

Handwerger et al.

[11] Patent Number: 5,100,094

[45] Date of Patent: Mar. 31, 1992

[54] ANGLED PICTURE FRAME HANGER

[75] Inventors: Leroy Handwerger, Baltimore; James I. Seybold, Reisterstown, both of Md.

[73] Assignee: Break Through Technologies, Inc., Baltimore, Md.

[21] Appl. No.: 729,160

[22] Filed: Jul. 12, 1991

[51] Int. Cl.[5] ..... A47G 1/16

[52] U.S. Cl. ..... 248/489; 40/156

[58] Field of Search ..... 248/489, 490, 493, 496; 40/152.1, 153, 156; 24/115 K

[56] References Cited

U.S. PATENT DOCUMENTS

| | | | |
|---|---|---|---|
| 1,147,863 | 7/1915 | Hickerson | 248/489 |
| 1,210,034 | 12/1916 | Bishop | 248/489 |
| 1,340,711 | 5/1920 | Greenwald . | |
| 1,959,745 | 5/1934 | Stout | 248/489 |
| 3,441,301 | 4/1969 | Cale | 24/115 KX |
| 3,596,392 | 8/1971 | Vani | 40/156 |
| 3,702,709 | 11/1972 | Shaffer | 24/115 KX |
| 4,216,597 | 8/1980 | Kocina | 40/152.1 X |
| 4,233,764 | 11/1980 | Small . | |
| 4,932,146 | 6/1990 | Long | 40/156 |

*Primary Examiner*—J. Franklin Foss

*Attorney, Agent, or Firm*—Fleit, Jacobson, Cohn, Price, Holman & Stern

[57] ABSTRACT

An angled picture frame hanger assures safe and secure hanging of wooden picture frames with narrow moldings under heavy weight loading and/or soft wood moldings of all widths. The hanger includes a flat metal plate with two screw holes. At right angles to the plate are flange portions that overlap and butt against an inner edge of a rear of the frame. An angled hook portion is connected to the flat plate. Wire or cord is attached through the angled hook portion and the frame is ready for hanging on a wall or other support. The flange portions act as a brace against the weakening of the frame due to splitting of the wood fibers by the fastening screws. The angled hook portion reduces the forces of the pull of wire or cord to lessen the stress upon the attached flat plate.

16 Claims, 1 Drawing Sheet

ANGLED PICTURE FRAME HANGER

FIELD OF THE INVENTION

This invention relates to an angled hanger for picture frames.

BACKGROUND OF THE INVENTION

For the current construction of wooden picture frames, there are two devices available for attachment to the back of the frame and through which wire or cord is attached to permit the hanging of the frame. The hanging devices currently employed are the old-fashioned screw eyes and a modernistic device known as hanging plates (also known as "super steel plates").

The traditional screw eye is a circular device defining an "eye" with a threaded stem portion. The stem is screwed into the back of the wooden frame and wire or cord is attached through the "eye" to allow for hanging of the frame.

The screw eye is the most widely used hanging device. This device, however, particularly on frames having a narrow rear edge, or where the molding involves soft wood, has been found unsuitable for hanging medium and heavy weight picture frames. Under such circumstances, the screw eye is subject to splitting the frame where attached and pulling out from the frame under medium and heavy weight loads.

A hanging plate or shoulder hook is a flat piece of metal having a central portion with a hole therein. The central portion is bent from the plate. The plate is screwed into the back edge of the frame through screw holes provided in the plate, and wire or cord is attached through the central portion to allow for hanging of the picture frame.

The hanging plate device is most often used on narrow rear edge moldings. They, like screw eyes, have been found to be ineffective. There is difficulty in aligning the screw holes of the hanging plate within the center of the molding. Under stress from heavy loading, the rear edge of the frame is subject to splitting, thus weakening the security of the attached plate. The hanging plate device, particularly on narrow rear edge moldings, because of center alignment difficulty, will sometimes protrude beyond the visible outer edge of the frame. This protrusion is cosmetically undesirable.

The present invention has been developed to overcome the problems prevalent in currently used picture frame hanging devices.

SUMMARY OF THE INVENTION

The present invention replaces the existing devices currently attached to the back of wooden frames through which wire or cord is passed to provide for hanging of the frames. This invention is particularly adaptable for efficient, expedient and secure use on narrow rear edged picture frame moldings and on soft wood moldings of all widths.

The angled picture frame hanger of the invention includes a flat plate with a flange portion formed to overlap and butt up against the inner edge of the rear edge of the frame, together with an angled hook portion through which the wire or cord is passed. The angled hook portion alleviates the weaknesses prevalent in the currently used hanging devices.

The flange portions overlap the molding and are placed against its inner rear edge. The flange portions thereby reinforce the wood molding by acting as a brace and are a retaining measure against the stress caused by the splitting of the wood fibers during attachment of the flat plate to a frame by screws.

The angle of the hook portion through which the wire or cord passes allows the frame to be hung in the direction of the forces of the wire on the hook portion, to thereby diminish the stress on the flat plate attached to the rear edge of the frame. This further assures the stability and security of this hanging device.

Screw holes centered in the flat plate and spaced equally from the inner edge of the frame by the flange portions allow immediate and accurate alignment of the flat plate within the rear edge of the molding. This is accomplished by simply butting the flange portions against the inner edge of the rear of the molding.

The angled picture frame hanger of this invention, with its flat plate flange portions and angled hook portion, alleviates all stresses created in hanging of all picture frames, and is particularly effective in narrow moldings subjected to heavy loading and in soft wood moldings regardless of width.

It is an object of the present invention to have an angled picture frame hanger including a flat plate with screw holes, downwardly extending flange portions and an upwardly extending extension portion connected to an angled hook portion.

It is another object of the present invention for an angled picture frame hanger to reinforce an area of a wood picture frame where a flat plate portion is screwed to the wood picture frame molding to prevent splitting of the wood.

It is yet another object of the present invention for an angled picture frame hanger to include depending flange portions for automatically aligning a flat plate portion within the edges of a frame to rapidly center screw holes of the flat plate portion with a tapered edge of the flange portions allowing for piercing through any dust cover that may be attached on the rear of the frame.

It is still yet another object of the present invention for an angled picture frame hanger to include an angled hook portion aligned in the direction of the forces of pull of a wire threaded through the angled hook portion to prevent the sides of the molding from bowing.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
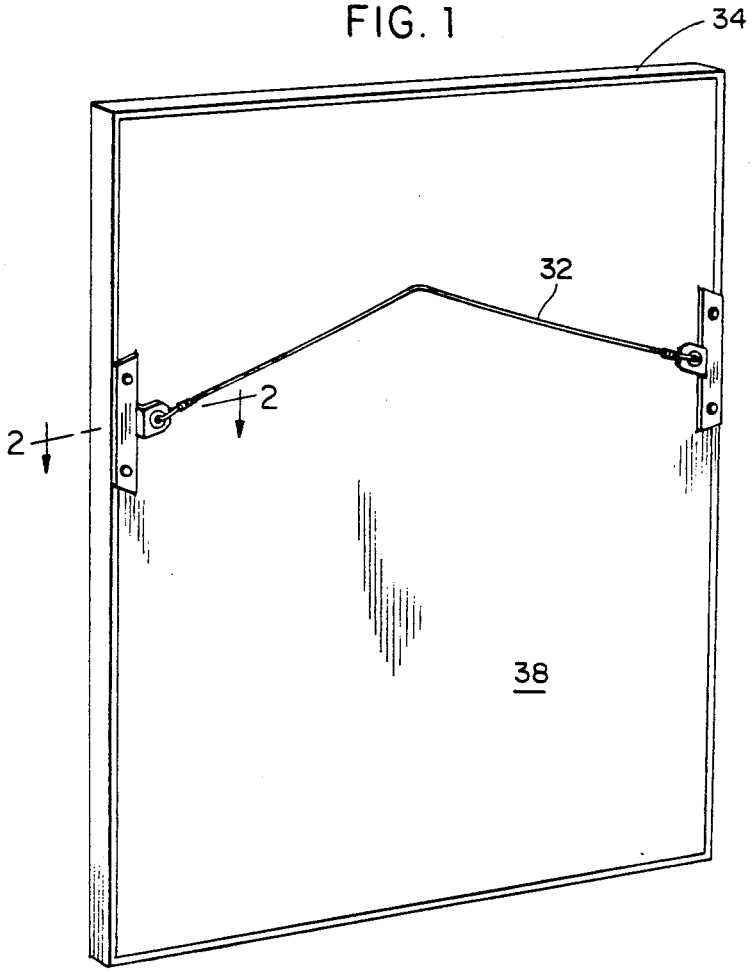
FIG. 1 is a perspective rear view of a picture frame employing the present invention.
Figure 3:
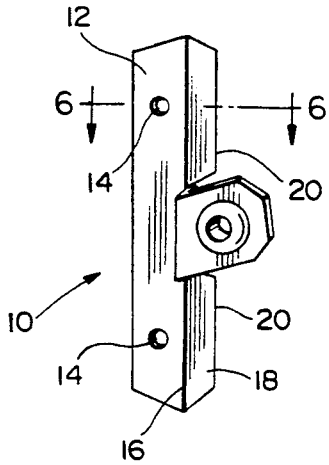
FIG. 3 is a front perspective view of an angled picture frame hanger.
Figure 4:
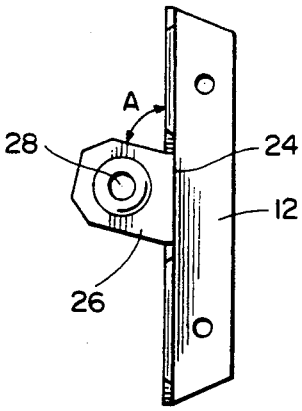
FIG. 4 is a rear view of the angled picture frame hanger.

In describing a preferred embodiment of the invention illustrated in the drawings, specific terminology will be resorted to for the sake in clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 3 through 6, in particular, an angled picture frame hanger, preferably made of metal, embodying the teachings of the subject invention is generally designated as 10. With reference to its orientation in FIG. 3, the angled picture frame hanger comprises a flat plate portion 12 having two nail or screw holes 14 equally, laterally spaced from an edge 16. Extending downwardly for approximately $\frac{1}{8}$–$\frac{1}{4}$", at an angle of 90° from flat plate portion 12 and edge 16, are two flange portions 18 terminating at edges 20.

Figure 5:
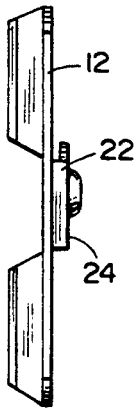
FIG. 5 is a side view of the angled picture frame hanger.
Figure 6:
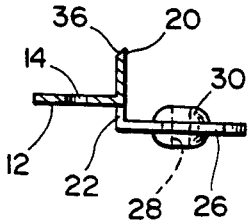
FIG. 6 is a cross-sectional view taken along line 6—6 of FIG. 3.

As shown in FIGS. 5 and 6, extending upwardly at an angle of 90° from edge 16 of flat plate portion 12 is extension portion 22 having a height of approximately $\frac{1}{8}$". Extending from edge 24 of extension portion 22 is angled hook portion 26. Hook portion 26 extends at an angle A, with respect to edge 16, in the range of 70°–80°, preferably 75°.

Angled hook portion 26 includes a hole 28 of 3/16" diameter, through which wire or cord is threaded to hang a picture frame. Optionally, a protective grommet or rubber or plastic washer 30 passes through hole 28 for reducing friction that may develop from wire rubbing against the edge of hole 28 so as to thereby minimize the risk of wire failure. Angled hook portion 26 is elevated approximately $\frac{1}{8}$" above flat plate portion 12.

Figure 2:
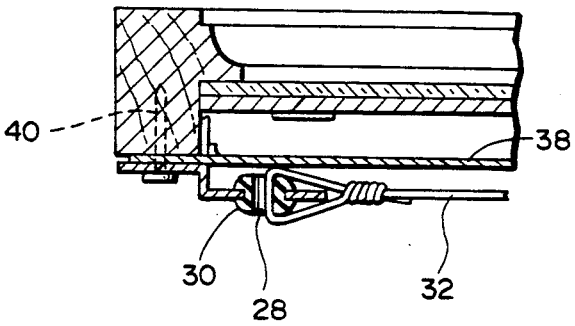
FIG. 2 is a cross-sectional view taken along line 2—2 of FIG. 1.

Angled hook portion 26 extends in the direction of pull of a wire 32 as shown in FIGS. 1 and 2 for hanging of a picture frame 34.

As best shown in FIG. 6, edge 20 of flange portions 18 includes an angled surface 36 to define a point at edge 20. The point at edge 20 permits insertion of the angled picture frame hanger 10 through a paper cover or dust cover 38, as shown in FIG. 2.

In use, two angled picture frame hangers of the present invention, as shown in FIGS. 1 and 2, are placed along the rear edge of a frame 34 by locating flange portions 18 along the innermost edge of the molding forming the frame. If necessary, the point at edge 20 pierces a paper cover or dust cover 38.

By aligning the flange portions 18 along the innermost edge of the molding, the flat plate portion 12 lies along the rear edge of the molding and automatically spaces holes 14 an equal distance from the innermost edge of the molding. Nails or screws 40 extend through holes 14 to secure the angled picture frame hanger 10 to the molding. During entry of the nail or screw 40 into the molding, the flange portions 18 reinforce the area of the molding where the flat plate portion is being secured to the molding to prevent splitting of the wood, which would ordinarily occur in narrow moldings.

Angled hook portion 26, extending above the flat plate portion 12, extends in the direction of the forces pulling on the angled hook portion by wire 32 which passes through hole 28 of the angled hook portion 26. Since the angled hook portion 26 is close in proximity to the plate 12, hanging of the plate 34 is achieved with almost a flush appearance without an exposed portion of the angled picture frame hanger. Optionally, washer 30 prevents failure of wire 32 caused by the friction of wire 32 against the edges of hole 28. The washer 30 also absorbs slight shock when the picture is initially hung.

Having described the invention, many modifications thereto will become apparent to those skilled in the art to which it pertains without deviation from the spirit of the invention as defined by the scope of the appended claims.

We claim:

1. A picture frame hanger comprising:

a flat plate portion adapted to be secured to a picture frame, at least one flange portion extending at an angle from said flat plate portion for abutting an innermost edge of molding of the picture frame to align said flat plate portion on the rear of the picture frame and for piercing a dust cover extending across the back of a frame, an extension portion extending from said flat plate portion, and a hook portion extending at an angle from said extension portion, above and in a direction away from said flat plate portion, said hook portion extending in a plane parallel to a plane of said flat plate portion, and said hook portion including means for securing a wire or string to the hook portion to hang the picture frame.

2. A picture frame hanger as claimed in claim 1, wherein said at least one flange portion extends downwardly from said flat plate portion at an angle of 90°.

3. A picture frame hanger as claimed in claim 1, wherein said hook portion extends at an angle of less than 90° to a common edge of said flat plate portion and said at least one flange portion.

4. A picture frame hanger as claimed in claim 3, wherein said hook portion extends at an angle of 75°.

5. A picture frame hanger as claimed in claim 1, wherein said means includes a hole in said hook portion.

6. A picture frame hanger as claimed in claim 5, wherein a washer extends through said hole to prevent wire or string threaded through said hole from being cut by edges of said hole.

7. A picture frame hanger as claimed in claim 1, wherein there are two flange portions separated from each other.

8. A picture frame hanger as claimed in claim 7, wherein said two flange portions are located on opposite sides of said extension portion.

9. A picture frame hanger as claimed in claim 1, wherein said at least one flange portion includes a sharp edge for piercing of a dust cover of the picture frame.

10. A picture frame hanger comprising:

a flat plate portion, two holes in said flat plate portion spaced from one edge of said flat plate portion, two flange portions extending downwardly at an angle of 90° from said one edge of said flat plate portion and located adjacent to said two holes for abutting an innermost edge of molding of a picture frame to position said flat plate portion on the rear of the picture frame and for reinforcing the molding where a nail or screw extends through said to holes to secure said flat plate portion to the picture frame, an extension portion extending from said one edge of said flat plate portion, and a hook portion extending at an angle from said extension portion, above and in a direction away from said flat plate portion, said hook portion including means for securing a wire or string to the hook portion to hang the picture frame.

11. A picture frame hanger as claimed in claim 10, wherein said two holes of said flat plate portion are spaced equally from said one edge of said flat plate portion.

12. A picture frame hanger as claimed in claim 10, wherein said hook portion extends at an angle of less than 90° to said one edge of said flat plate portion.

13. A picture frame hanger as claimed in claim 12, wherein said hook portion extends at an angle of 75°.

14. A picture frame hanger as claimed in claim 10, wherein said means includes a hole in said hook portion.

15. A picture frame hanger as claimed in claim 14, wherein a washer extends through said hole to prevent wire or string threaded through said hole from being cut by edges of said hole.

16. In combination, a picture frame and two picture frame hangers secured on opposite sides of said picture frame, said two picture frame hangers each including a flat plate portion having two holes spaced equally from one edge of the flat plate portion, said flat plate portion being secured to a rear of molding forming said picture frame by screws or nails extending through said holes of said flat plate portion, two flange portions extending downwardly from said one edge of said flat plate portion and being aligned against an innermost edge of the molding an adjacent to said holes of said flat plate portion to reinforce the molding where the nails or screws extend through said two holes, an extension portion extending upwardly from said one edge of said flat plate portion and being connected with a hook portion having a hole, said hook portion extending above and in a direction away from said flat plate portion with a wire or string extending through the hole of each hook portion to hang the picture frame on a hook secured to a wall and said hook portion extending in a direction of force of said wire at an angle to said one edge of said flat plate portion.

* * * * *

UNITED STATES PATENT AND TRADEMARK OFFICE

Certificate

Patent No. 5,100,094

Patented: March 31, 1992

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Lisa L. Handwerger and Muriel A. Handwerger.

Signed and Sealed this Fifteenth Day of February, 2000.

LESLIE A. BRAUN
*Supervisory Patent Examiner*
Art Unit 3632